US005224609A

United States Patent [19]

Bauer et al.

[11] Patent Number: 5,224,609

[45] Date of Patent: Jul. 6, 1993

[54] MERCHANDISE DISPLAY SYSTEM

[75] Inventors: Jamie Bauer, New Providence, N.J.; Paul R. Burger, Milford, Ohio

[73] Assignee: The Drackett Company, Cincinnati, Ohio

[21] Appl. No.: 832,242

[22] Filed: Feb. 7, 1992

[51] Int. Cl.[5] ..... A47F 7/00

[52] U.S. Cl. ..... 211/65; 211/70.6; 211/94; 211/87; 248/220.3; 248/220.4

[58] Field of Search ..... 211/70.6, 87, 65, 66, 211/94; 248/220.3, 220.4, 221.1, 221.2

[56] References Cited

U.S. PATENT DOCUMENTS 3,285,426 11/1966 Wilcke ..... 211/70.6
4,576,291 3/1986 Stein ..... 211/49.1
4,619,428 10/1986 Bailey ..... 248/221.2
4,723,663 2/1988 Learn ..... 211/59.2
4,823,964 4/1989 Lundberg ..... 211/57.1

*Primary Examiner*—Robert W. Gibson, Jr.

[57] ABSTRACT

A merchandise display system for merchandise that has a narrow elongated body and a head that is wider than that body, such a mops, brooms, rakes, hoes and the like. The merchandise display system of this invention comprises an I-shaped bracket that comprises a vertical support beam that joins an upper horizontal cross beam and a lower horizontal cross beam and means for mounting the I-shaped bracket to the pegboard. It further comprises a left and a right product bracket. Each of these brackets comprise a support column, a product arm attached to the support column, and at least one tongue member forming with the support column, a notch that slidably engages the left or right side, respectively, of the upper horizontal cross beam of the I-shaped bracket.

12 Claims, 3 Drawing Sheets

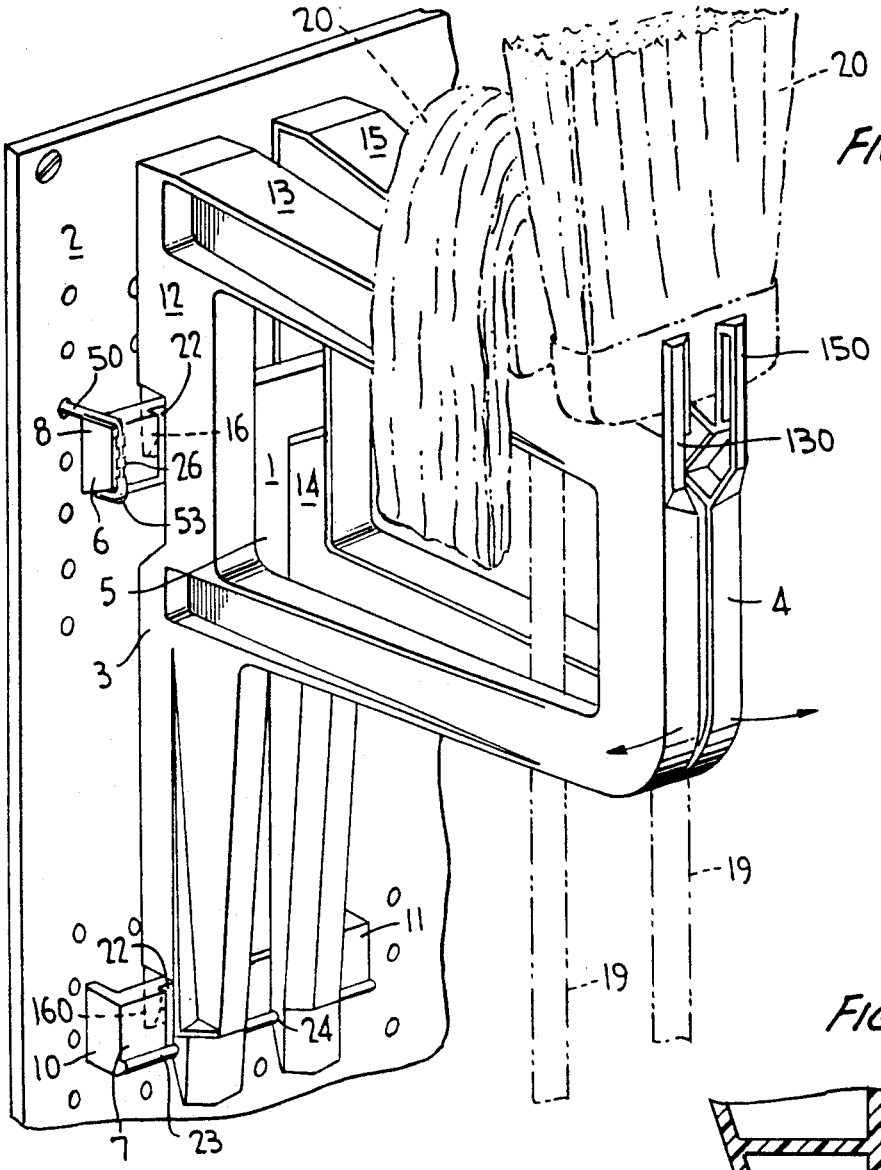
FIG. 1
FIG. 4
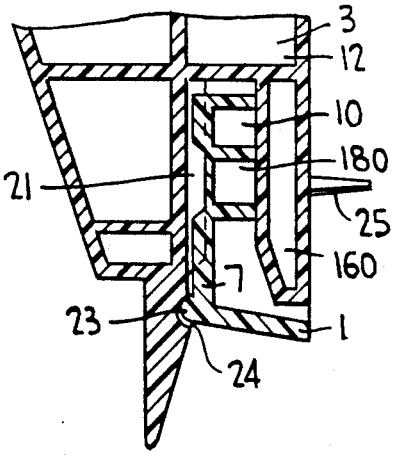
FIG. 3
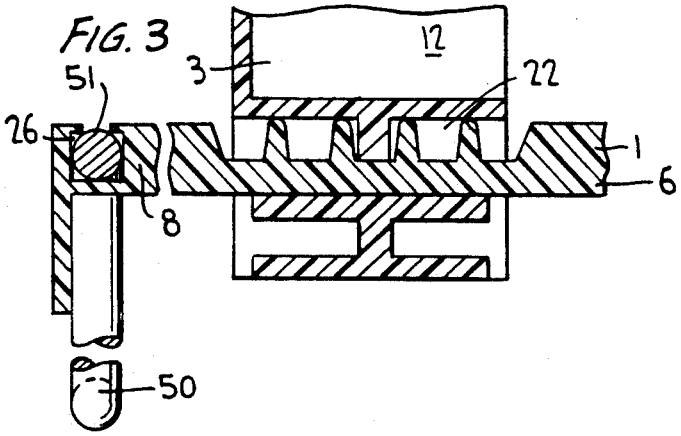

FIG. 2
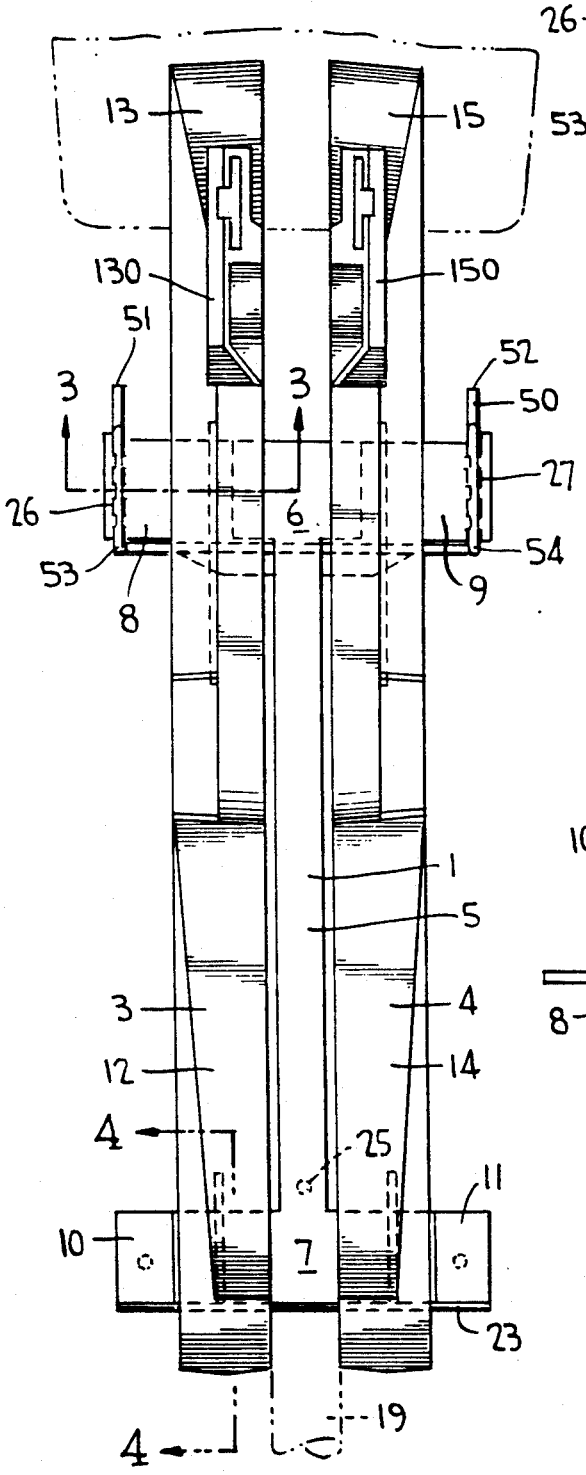
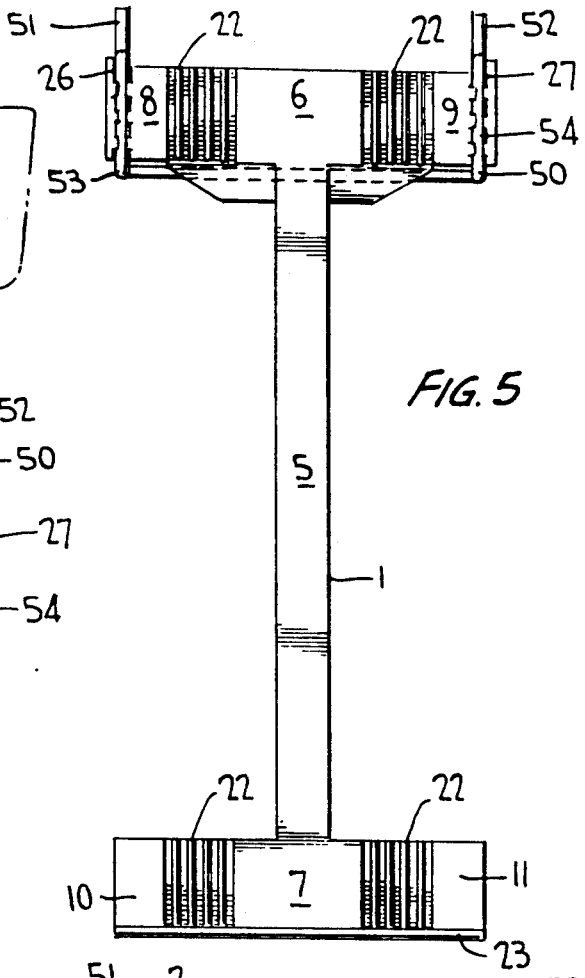
FIG. 5
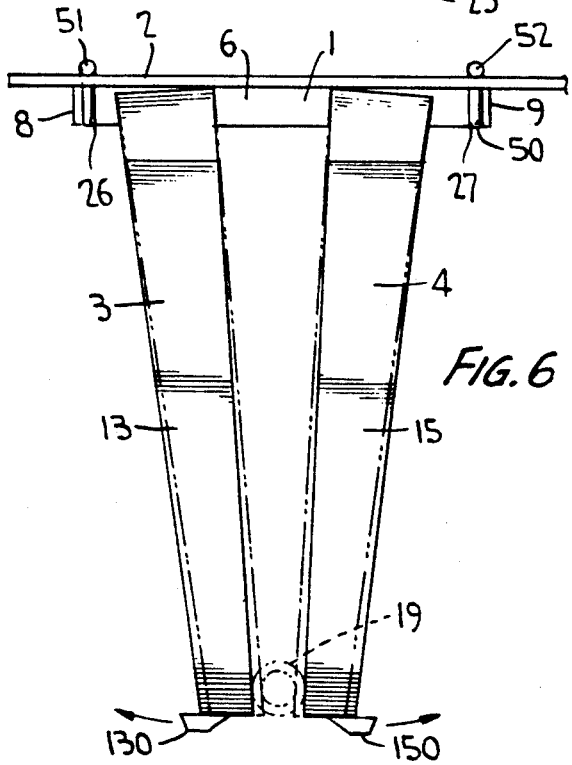
FIG. 6

MERCHANDISE DISPLAY SYSTEM

BACKGROUND OF THE INVENTION

This invention relates to a system for displaying merchandise that has a narrow elongated body and a head that is wider than that body. Such merchandise includes mops, brooms, rakes, hoes, certain tools, etc.

This type of merchandise has typically been displayed upright in a tall bin. However, this display system is an inefficient use of merchandise display space. It also falls over easily and appears disorganized to the consumer.

Pegboards—a supporting surface containing a series of holes that are the same size, aligned horizontally and vertically, and equidistant from each other—have also been widely used in display systems for merchandise with a narrow elongated body and a head that is wider than that body. These systems often include a wire support member with two rear projections that are inserted into the pegboard holes. These two rear projections are angled upward to help retain the wire support member in the pegboard. Merchandise is hung through a hole, on a single front projection of the wire support member. The tip of this front projection is often angled upward to help retain the merchandise. However, this type of display system is not strong—the weight of many heavy mops and brooms might cause the wire support member to sink down and the merchandise to fall off. This type of display system is also not stable—when the consumer removes merchandise from the wire support member, the support member often disengages from the pegboard and the display must be set up anew. Furthermore, in order to reposition groups of merchandise that are displayed using this system, each individual merchandise unit must be removed from the wire support member and replaced, one at a time, on the repositioned support member.

U.S. Pat. No. 4,619,428 discloses a support member, for use with a pegboard, that is locked to the pegboard by rear projections that are long enough to clear the rear face of the pegboard and that have tabs, which when inserted into the pegboard, overlap and engage the rear face of the pegboard. Although this invention may solve the stability problems encountered with traditional pegboard systems, it is not strong and does not make it easier or more efficient to reposition merchandise on the pegboard.

U.S. Pat. No. 4,823,964 discloses a holder for "pinpacks" that when filled with merchandise can be repositioned on the pegboard. The holder has a horizontal arm, one end of which has means for insertion into a pegboard and the other end of which has a carrying assembly, a horizontal pin that is removably connected to the arm, and a cutting assembly connected to the pin. Although this invention allows merchandise to be repositioned without removing each unit from the holder, it does not solve the stability problem.

Even merchandise display systems designed specifically for mops, brooms, rakes, hoes, and the like have many functional deficiencies. U.S. Pat. No. 4,723,663 discloses a merchandise display system that permits lateral adjustment of the merchandise without requiring the removal and replacement of the hooks from which the merchandise is hung. This system comprises a pegboard, a plurality of horizontal tracks comprising vertically spaced horizontal rails and integral pegboard securing fasteners. The tracks are placed horizontally on the pegboard at various vertically and transversely spaced locations. Each track includes at least an upper and a lower rail for removable engagement and support of a plurality of various shaped product support hooks. The mop and broom hooks used in this system comprise a pair of horizontally spaced arms of generally trapezoidal configuration. These arms may be downwardly inclined so that when a mop or broom is removed from the display, the remaining mops or brooms will slide forward automatically. These arms may also have bent retainers that prevent a mop or broom from unintentionally falling off the display. The arms terminate at their pegboard ends in upper and lower bent catches. The bent catches allow the hook to be attached to a horizontal track. Although this display system is an improvement over earlier display systems, it is still unstable, allows hooks to be repositioned only within a narrow lateral range, and cannot be adjusted to accommodate many different widths of narrow elongated merchandise bodies.

U.S. Pat. No. 4,576,921 discloses a display system for "long handled articles such as brooms, mops and the like" (stick merchandise) and for "smaller articles, usually packages, displayed by being hung from pegs" (peg merchandise). The system comprises stick merchandise storage and display compartments, and peg merchandise storage and display compartments that alternate with the stick merchandise compartments. These compartments are formed by intersecting merchandise support frames that form a lattice-like structure that may be assembled without fastening means. The features of this display system include efficient utilization of display space, attractiveness to the consumer, and high resistance to being tipped over. However, this display system cannot easily be adjusted to accommodate many different widths of narrow elongated merchandise bodies, it is difficult to reposition the display without having to remove and replace each individual merchandise unit, and it does not make use of the traditional pegboard supports that are already in place in many displays.

SUMMARY OF THE INVENTION

This invention provides a merchandise display system for use with a pegboard. It comprises an I-shaped bracket that comprises a vertical support beam that joins an upper horizontal cross beam and a lower horizontal cross beam, and means for mounting the I-shaped bracket to the pegboard. It further comprises a left and a right product bracket. Each of these brackets comprise a support column, a product arm attached to the support column, and at least one tongue member forming with the support column, a notch that slidably engages the left or right side, respectively, of the upper horizontal cross beam of the I-shaped bracket. The product brackets may also have at least one notch that slidably engages with the left or right side of the lower horizontal cross beam of the I-shaped bracket.

The cross beams of the I-shaped bracket may also comprise a vertical placement slot (or a series of vertical placement slots) that, when the product bracket notch engages the I-shaped bracket cross beam, securely receive a vertical placement rib (or vertical placement ribs) that is formed as part of the notch. The notches of the left and right product brackets may also each comprise a horizontal locking slot that, when the product bracket notch engages the I-shaped bracket cross beam, lockably receives a horizontal locking rib that is formed as part of the cross beam.

The product arms of the product brackets may slant down from their point of attachment to the support column, and may also terminate in a product stop tab. The I-shaped bracket may also comprise at least one stabilizing pin that is adapted for insertion into the pegboard.

The means by which the I-shaped bracket is mounted to the pegboard may comprise a mounting wire that has two ends adapted for secure insertion into the pegboard, and that has been angled to form opposed U-recesses for lockable insertion into slots in the left and right sides of the upper horizontal cross beam of the I-shaped bracket.

It is an object of this invention to provide a new merchandise display system for products that have a narrow elongated body and a head that is wider than that body, such as mops, brooms, rakes, hoes, certain tools, etc.

It is also an object of this invention to provide a merchandise display system that makes efficient use of available display space.

It is also an object of this invention to provide a merchandise display system that allows merchandise to be displayed in an organized manner that is pleasing to the consumer.

It is further an object of this invention to provide a merchandise display system that can be easily adjusted to accommodate different widths of narrow elongated merchandise bodies.

It is also an object of this invention to provide a merchandise display system that is strong and therefore can hold a large number of merchandise units.

It is further an object of this invention to provide a merchandise display system that is stable and therefore will not fall over or come apart.

It is also an object of this invention to provide a merchandise display system that allows merchandise to be repositioned easily and efficiently on the pegboard.

DESCRIPTION OF THE DRAWINGS

FIG. 1 is a perspective view of the merchandise display system.

FIG. 2 is an elevated front view of the merchandise display system.

FIG. 3 is a sectional view of the merchandise display system taken along line 3—3 of FIG. 2.

FIG. 4 is a sectional view of the merchandise display system taken along line 4—4 of FIG. 2.

FIG. 5 is an elevated perspective view of the I-shaped bracket and the means for mounting that bracket to the pegboard.

FIG. 6 is a top view of the merchandise display system.

DETAILED DESCRIPTION OF THE PREFERRED EMBODIMENTS

Figure 7:
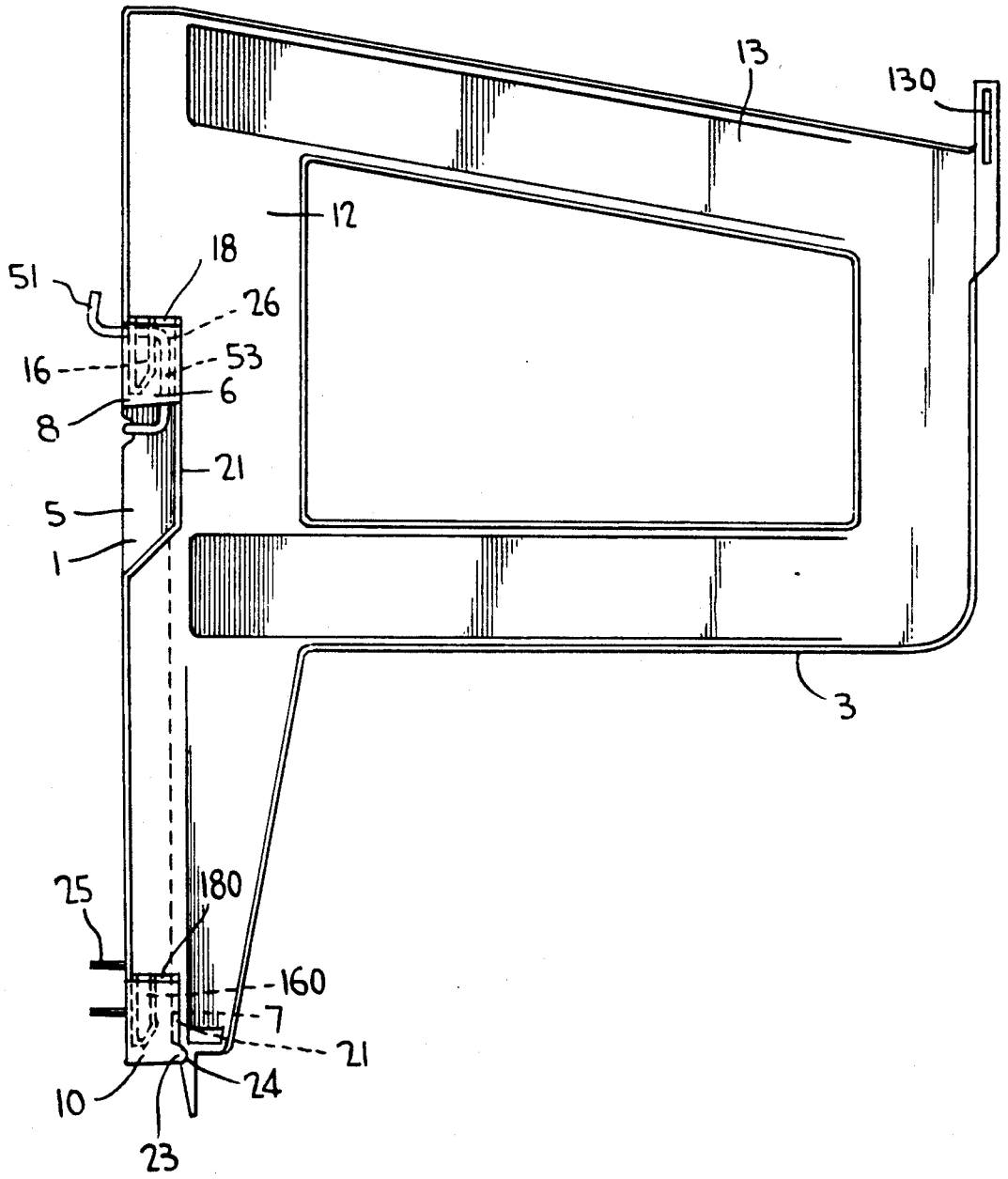
FIG. 7 is an elevated left side view of the merchandise display system.

The merchandise display system of this invention, as shown in FIGS. 1–7, comprises an I-shaped bracket 1, means for mounting the I-shaped bracket to a pegboard 2, and a left 3 and a right product bracket 4. The I-shaped bracket 1 comprises a vertical support beam 5 joining an upper horizontal cross beam 6 and a lower horizontal cross beam 7. Each cross beam has a left 8,10 and a right 9,11 side.

The left 3 and right product brackets 4 each comprise a support column 12,14 a product arm 13,15 attached to the support column 12,14, and at least one tongue member 16 forming with the support column 12,14, a notch 18 that slidably engages with the left side 8 or right side 9, respectively, of the upper horizontal cross beam 6 of the I-shaped bracket 1. The narrow elongated merchandise bodies 19 hang in the space between the left 3 and right product brackets 4, and the merchandise heads 20, which are wider than the bodies, rest on the left 13 and right product bracket product arms 15. Preferably, the left 3 and right product brackets 4 also each comprise another tongue member 160 forming with the support column 12,14, another notch 180 that slidably engages the left 10 and right 11 sides, respectively, of the lower horizontal cross beam 7 of the I-shaped bracket 1. This configuration provides a merchandise display system that is strong and stable.

As best shown in FIGS. 4 and 5, the left 8,10 and/or right side 9,11 of the upper horizontal cross beam 6 and/or lower horizontal cross beam 7 may also each comprise at least one vertical placement slot 22. Correspondingly, as shown in FIGS. 4 and 7, the notches 18,180 of the left 3 and/or right product brackets 4 may also each comprise a vertical placement rib 21 that is formed as part of the notch 18,180. When the notch 18,180 engages with the cross beam 8,9,10,11, the vertical placement slot 22 securely receives the vertical placement rib 21. Alternatively, the horizontal cross beams 8,9,10,11 may comprise a series of vertical placement slots 22, which may be sequentially numbered. Likewise, the notches 18,180 may comprise more than one vertical placement rib. In the preferred embodiment of this invention, the left 8,10 and right 9,11 sides of the upper 6 and lower 7 horizontal cross beams each comprise a series of sequentially numbered vertical placement slots 22, and the corresponding notches 18,180 each comprise a single vertical placement rib 21. These vertical placement slots 22 and ribs 21 allow lateral adjustment of the left 3 and right product brackets 4. Thus, the space between the left and right product brackets can be varied to accommodate different widths of narrow elongated merchandise bodies.

The left 8,10 and/or right side 9,11 of the upper horizontal cross beam 6 and/or lower horizontal cross beam 7 may also each comprise a horizontal locking rib 23. Correspondingly, the notches 18,180 of the left 3 and/or right product brackets 4 may also each comprise a horizontal locking slot 24 that is formed as part of the notch 18,180. When the notch 18,180 engages with the cross beam 8,9,10,11, the horizontal locking slot 24 lockably receives the horizontal locking rib 23. The horizontal locking slot 24 and horizontal locking rib 23 insure that the engagement of the product brackets 3,4 and the I-shaped bracket 1 is stable. Preferably, the left 10 and right sides 11 of the lower horizontal cross beam 7 each comprise a locking rib 23, and the corresponding notches on the left 3 and right product brackets 4 each comprise a horizontal locking slot 24.

In the preferred embodiment of this invention, the product arms 13,15 of the left 3 and right product brackets 4 each terminate in a product stop tab 130,150 that will prevent the merchandise from inadvertently falling off the product arms. In addition, the product arms 13,15 slant down from their point of attachment to the support column 12,14. Thus, when the forward-most merchandise unit is removed from between the product brackets 3,4, the next merchandise unit will slide down the slanted product arms 13,15 into the forward-most position where it will be retained on the product arms13,15 by the product stop tabs 130,150. Merchandise displayed in this manner will be well organized and readily visible to the consumer.

The I-shaped bracket 1 of the merchandise display system of this invention may also comprise at least one stabilizing pin 25 that is adapted for insertion into the pegboard. Preferably, the I-shaped bracket 1 comprises three stabilizing pins 25 that are located in the area where the lower horizontal cross beam is joined to the vertical support beam. These stabilizing pins 25 give additional strength and stability to the merchandise display system of this invention.

In the preferred embodiment of the merchandise display system of this invention, the means for mounting the I-shaped bracket to the pegboard comprise a mounting wire 50, having two ends 51,52, adapted for secure insertion into the pegboard. This mounting wire 50 is angled to form opposed U-shaped recesses 53,54 for lockable insertion into the left 8 and right sides 9 of the upper horizontal cross beam 6 of the I-shaped bracket 1. Correspondingly, the the left 8 and right sides 9 of the upper horizontal cross beam 6 of the I-shaped bracket 1 will comprise slots 26,27 for lockably receiving the mounting wire 50.

It will be apparent to those skilled in the art that the invention described herein can be practiced by other than the embodiments described above, which are presented for the purpose of illustration and not of limitation, and the present invention is limited only by the claims that follow.

I claim:

1. A merchandise display system, for use with a pegboard, comprising an I-shaped bracket comprising a vertical support beam joining an upper horizontal cross beam and a lower horizontal cross beam, each cross beam having a left and a right side;

means for mounting the I-shaped bracket to the pegboard; and a left and a right product bracket each comprising a support column, a product arm attached to the support column, and at least one tongue member forming with the support column a notch slidably engaging the left side or right side, respectively, of the upper horizontal cross beam of the I-shaped bracket.

2. The merchandise display system of claim 1 wherein the left and right product brackets comprise at least one tongue member forming with the support column, a notch slidably engaging the left side or right side, respectively, of the lower horizontal cross beam of the I-shaped bracket.

3. The merchandise display system of claim 1 or 2 wherein at least one of the left side or right side of the upper horizontal cross beam or lower horizontal cross beam comprises a vertical placement slot, and at least one notch of the left or right product bracket comprises a vertical placement rib, the vertical placement slot securely receiving the vertical placement rib when the notch engages with the cross beam.

4. The merchandise display system of claim 3 wherein at least one of the left side or right side of the upper horizontal cross beam or lower horizontal cross beam of the I-shaped bracket comprises a series of vertical placement slots.

5. The merchandise display system of claim 4 wherein the series of vertical placement slots are sequentially numbered.

6. The merchandise display system of claim 3 wherein at least one notch of the left or right product bracket comprises more than one vertical placement rib.

7. The merchandise display system of claim 1 or 2 wherein at least one of the left side or right side of the upper horizontal cross beam or lower horizontal cross beam of the I-shaped bracket comprises a horizontal locking rib, and at least one notch of the left or right product bracket comprises a horizontal locking slot, the horizontal locking slot lockably receiving the horizontal locking rib when the notch engages with the cross beam.

8. The merchandise display system of claim 1 or 2 wherein the product arm terminates in a product stop tab.

9. The merchandise display system of claim 1 or 2 wherein the product arm slants down from the point of attachment to the support column and terminates in a product stop tab.

10. The merchandise display system of claim 1 or 2 wherein the I-shaped bracket comprises at least one stabilizing pin that is adapted for insertion into the pegboard.

11. The merchandise display system of claim 1 or 2 wherein the means for mounting the I-shaped bracket to the pegboard comprise a mounting wire having two ends adapted for secure insertion into the pegboard, the mounting wire being angled to form opposed U-recesses for lockable insertion into the left and right sides of the upper horizontal cross beam of the I-shaped bracket.

12. The merchandise display system of claim 11 wherein the upper horizontal cross beam of the I-shaped bracket comprises slots for lockably receiving the mounting wire.

* * * * *